United States Patent [19]

Raftery

[11] Patent Number: 4,580,841

[45] Date of Patent: Apr. 8, 1986

[54] MODULAR CHAIR SEAT STRUCTURE

[75] Inventor: William B. Raftery, Arlington, Tex.

[73] Assignee: Steelcase, Inc., Grand Rapids, Mich.

[21] Appl. No.: 588,243

[22] Filed: Mar. 12, 1984

[51] Int. Cl.[4] ..... A47C 7/02

[52] U.S. Cl. ..... 297/452; 297/442; 297/445

[58] Field of Search ..... 248/205.3; 312/140; 5/417, 420, 432, 433; 297/377, 445, 442, 452

[56] References Cited

U.S. PATENT DOCUMENTS

| | | | |
|---|---|---|---|
| 2,765,886 | 10/1966 | Tedolti et al. | 312/140 X |
| 3,120,008 | 2/1964 | Watson | 5/432 |
| 3,121,884 | 2/1964 | Emory | 5/433 |
| 3,808,616 | 5/1974 | White | 297/377 X |
| 3,880,535 | 4/1975 | Durham | 248/305.3 |
| 4,124,251 | 11/1978 | Peterson | 297/445 |
| 4,296,524 | 10/1981 | Horsholt et al. | 312/258 |
| 4,470,647 | 9/1984 | Bishoff et al. | 312/140 X |
| 4,503,780 | 3/1985 | Atiffoman | 312/140 |

*Primary Examiner*—James T. McCall

*Attorney, Agent, or Firm*—Alexander, Unikel, Bloom, Zalewa & Tenenbaum, Ltd.

[57] ABSTRACT

A chair seat structure is formed of a plurality of identically dimensioned planar members and a plurality of plastic connective members having slots to receive and engage the planar members. This construction provides easy handling, economical shipment and storage, and dimensional adjustability of the chair seats during manufacture. In use the chair seats can adjust to uneven floor surfaces which support the frame on which the chair seat is mounted. This adjustability under the weight of an occupant aids in preventing the chair from undergoing discomforting teetering.

19 Claims, 10 Drawing Figures

MODULAR CHAIR SEAT STRUCTURE

BACKGROUND OF THE INVENTION

1. Related Application

The chair seat structure of this disclosure is particularly applicable to structures shown in commonly assigned, co-pending U.S. patent application Ser. No. 494,568 filed May 13, 1983, and entitled Modular Furniture System.

2. Field of Invention

This invention relates to a plurality of separate components assembled to form a substantially non-warpable, dimensionally adjustable chair seat.

3. Description of Prior Art

Prior art chair seats which the present invention replaces have been comprised of one sheet of laminated wood. The laminated wood is formed into the desired configuration using heat and pressure.

Disadvantages of this prior art construction are that such seats are expensive to form; they are susceptible of warpage and, consequently, frequently unusable; they are difficult to mount to the supporting frame; and they are not adjustable. For example, if a formed chair seat is out of tolerance it must often be scrapped. Such scrappage imposes a severe cost penalty due to the investment the manufacturer has made in the purchase of the laminate, the forming of the laminate and, frequently, transporting the formed seat to the point of assembly. Also, such formed chair seats take up a good deal of space for transport and storage.

SUMMARY OF THE INVENTION

A chair seat is formed of three planar members or boards having substantially equal dimensions. As the boards have the same dimensions, they are interchangeable and may be placed in any of three positions in the chair seat.

The boards, which are preferably formed of a material such as pressed wood, are not subject to warpage when exposed to ambient changes in humidity and temperature.

Molded or extruded plastic members serve to connect the boards to each other and adapt the formed chair seat for attachment to a supportive base or frame member. The plastic connective members have engagement slots appropriately sized to receive edge portions of the boards. The boards are maintained engaged with the slots by appropriate means such as mechanical fasteners or adhesives.

DETAILED DESCRIPTION OF THE INVENTION

Figure 1:
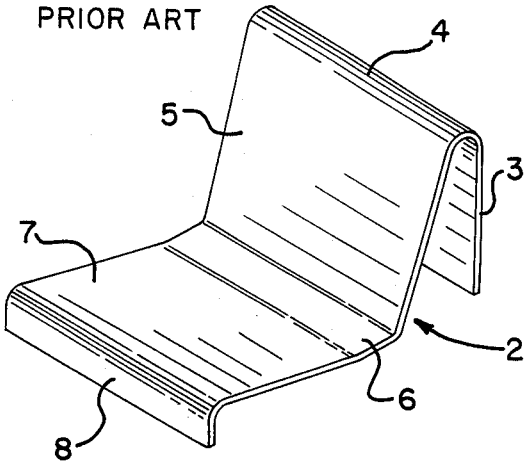
FIG. 1 PRIOR ART
FIG. 1 is a perspective view of a prior art chair seat formed of laminated wood.
Figure 2:
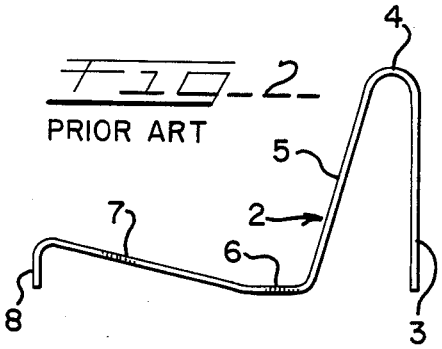
FIG. 2 PRIOR ART
FIG. 2 is an elevation view of the prior art chair seat shown in FIG. 1.

FIG. 1 shows, in perspective, a typical prior art chair seat consisting of a sheet of a laminated wood which has been formed from a substantially planar sheet into the configuration shown. FIG. 2 is a side elevation view of the prior art chair seat 2. These seat structures are formed using heat and pressure to mold the laminate to a desired form, such as that shown, in which the integral one-piece seat has a substantially planar back portion 3, a curved portion 4, a substantially planar back support portion 5, a center curved portion 6, a substantially planar seat support portion 7 and a forward curved portion 8.

While these prior art seat structures perform well in assembled chairs, they are susceptible to warpage from ambiant humidity prior to installation on a chair base, and they are cumbersome and expensive to ship and store. Moreover, if not made to close tolerances, they will not fit properly on the frame at the time of assembly of a chair since they are not adjustable.

Figure 3:
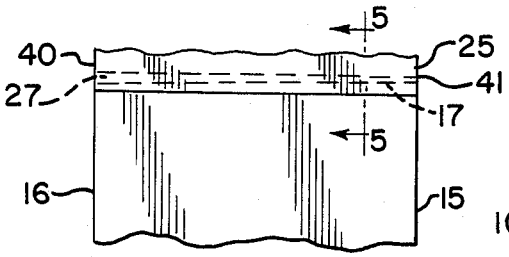
FIG. 3 PRIOR ART
FIG. 3 is a perspective exploded view of the chair seat of this invention in which the components are shown relative to each other prior to assembly.

FIG. 3 is a perspective view showing the components of a chair seat 10 of this invention which overcomes the disadvantages of the one piece molded prior art chair shown in FIGS. 1 and 2.

Chair seat 10 is comprised of three substantially planar members 11 which are substantially identical in size and shape and, consequently, interchangeable with each other.

Any member 11 can interchangeably serve as a back portion 12, the back support portion 13 or the seat support portion 14.

Each of the planar members 11, such as the member 11 used as the seat support portion 14, has a first side 15, a second side 16, a first connective end 17, a second connective end 18, a first surface, such as the upper surface 19 of planar member 11 used as seat support surface 14 and a lower surface 20. The members 11 are preferably manufactured or formed of a suitable material, such as fiber board, pressed wood, particle board, or the like, which is not susceptible to warpage due to ambient atmospheric conditions such as high or fluctuating humidity. A fiber board $\frac{3}{4}$ inch in thickness has adequate strength for most applications.

The planar members 11 used in positions 12 and 13 are connected together by a first connective member 21 having a first planar member connective end receiving slot 22 and a second planar member connective end receiving slot 23. A connective portion or bight 24 connects slot 22 and slot 23 and maintains the slots in a substantially parallel, laterally spaced relationship substantially as shown.

A second connective member 25 is used to connect together the planar members 11 used in the positions 13 and 14. Connective member 25 has a first planar member connective end receiving slot 26 and a second planar member connective end receiving slot 27. Slots 26 and 27 are connected together by a connective portion 28. Connective portion 28 maintains slots 26 and 27 in the laterally spaced, substantially parallel relationship shown. A plurality of openings, such as openings 29 and 30, are provided in connective portion 28 to receive appropriate attachment means, such as mechanical fasteners.

A third connective member 31, having a planar member connective end receiving slot 32, is provided to connect the planar member 11 occupying seat support position 14 to a chair base or frame. Connective member 31 is provided with a channel 33 which extends substantially parallel to connective slot 32. Channel 33 is provided with a plurality of openings, such as openings 34 and 35, adapted for receiving appropriate attachment means, such as mechanical fasteners. At a lower terminal end 35 of member 31 a rigidifying spacer flange 37 is provided.

A curved connective portion 38 connects slot 32 to channel 33 and maintains them in a substantially parallel laterally spaced relationship. Similarly, a connective portion 39 connects channel 33 and flange 37 together and maintains them in a substantially parallel, laterally spaced relationship.

Each of the connective members 21, 25, and 31 are preferably formed of a returningly deformable substantially rigid material having a limited degree of flexibility and the ability to return to its original shape after it has undergone slight flexing or deformation. For example, connective members formed of extruded polyvinylchloride (PVC) and having a average wall thickness of about 0.156 inch serve well. Such connective members are substantially rigid and, as previously indicated, they have good "memory" properties in that they tend to return to their original shape after being distorted.

Figure 4:
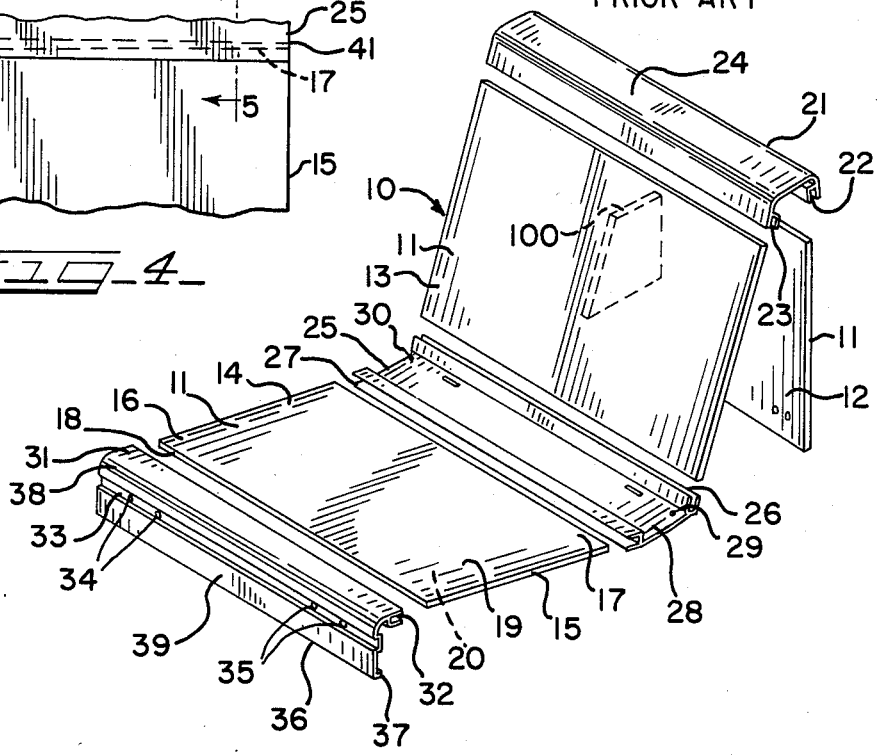
FIG. 4 is a partial top view showing the adjustable relationship of the edge of a board member to a slot in a connective member.

FIG. 4 shows a connective end of a planar member 11, such as end 17 of the member 11 in position 14, inserted into a slot of a connective member, such as slot 27 of connective member 25. In this figure, the end 17 of the planar member has been shown as skewed or not square with the sides 15 and 16 of the planar member. However, due to the fact that the slot is preferably ½ inch to 1 inch in depth, the board can be adjusted to have sides 16 and 15 be aligned with sides 40 and 41, respectively, of the connective member by skewing the end 17 in slot 27 substantially as shown. Thus, each of the members 11 can be adjusted for length or angle with respect to a connective member 21, 25, or 31 to obtain during assembly a chair seat with predetermined specifications to make each chair seat compatible with the base or frame on which it is to be installed.

Figure 5:
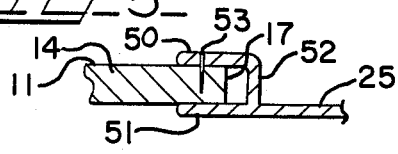
FIG. 5 is a sectional view of FIG. 4 as indicated by the section line 5—5.

FIG. 5 is a sectional view of FIG. 4 as indicated by the section line 5—5 and shows the typical relationship between a connective end 17 of a member 11, such as that occupying position 14, and a connective member receiving slot, such as slot 27 of connective member 25. Typical of each of the slots 22, 23, 26, and 32 of the connective members, slot 27 has a first wall 50, a second wall 51 parallel to and laterally spaced from the first wall and a connective wall 52 which maintains the walls 50 and 51 in the substantially parallel, laterally spaced relationship shown. Slot 27 has an open side through which a connective end portion 17 of a planar member 11 is received. Affixing means, such as a plurality of mechanical fasteners, such as staple 53, or a suitable adhesive, are preferably used to maintain the connective members in a desired fixed relationship with the connective slot.

Figure 6:
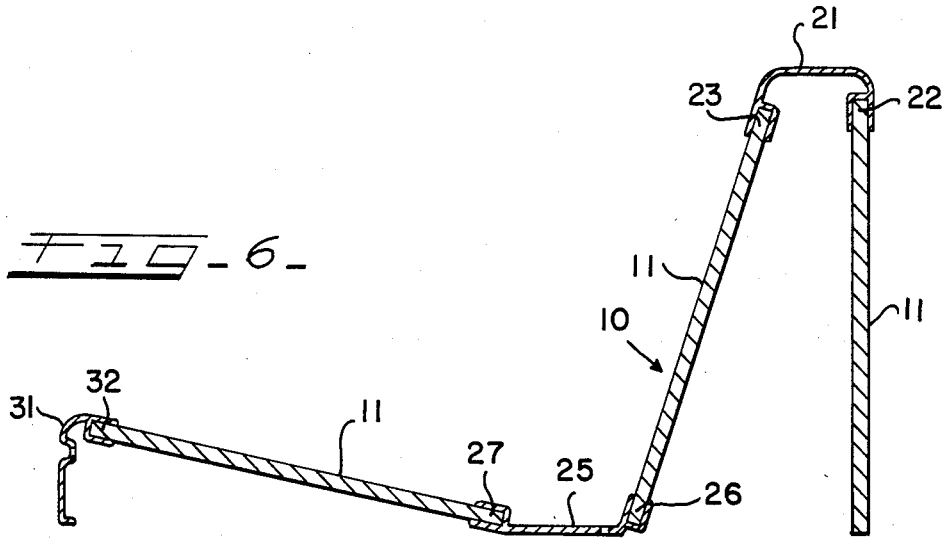
FIG. 6 is a side elevation view of the assembled components of a chair seat of this invention.

FIG. 6 is a side elevation view of the desired configuration of a typical chair seat structure 10 of this invention in which each of the three planar members 11 is dimensioned correctly and consequently each planar member 11 fully engages a connective slot 22, 23, 26, 27, and 32.

Figure 7:
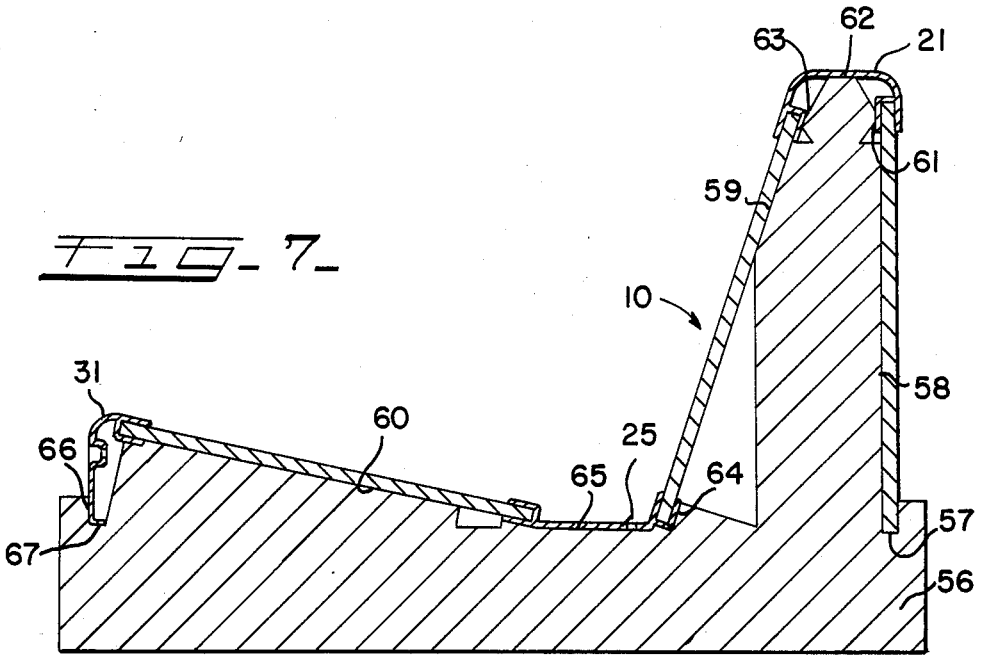
FIG. 7 is a side elevation view of the assembled components of a chair seat of this invention placed on a representative forming fixture.

FIG. 7 shows the chair seat 10 of FIG. 6 placed on a representative forming fixture 56. Forming fixture 56 provides locating surfaces 57, 58, 59, and 60 for locating planar members 11 and surfaces 61, 62, 63, 64, 65, 66, and 67 for locating connective members 21, 25, and 31 in their proper position with respect to each other.

Upon placement of chair seat 10 on fixture 56 the components are properly aligned and may be affixed to each other by use of appropriate affixing means, such as gluing or adhering members 11 to connective members 21, 25, and 31 or by mechanical fasteners, such as staples or brads, as shown in FIG. 5 to form a substantially rigid, dimensionally stable chair seat.

Figure 10:
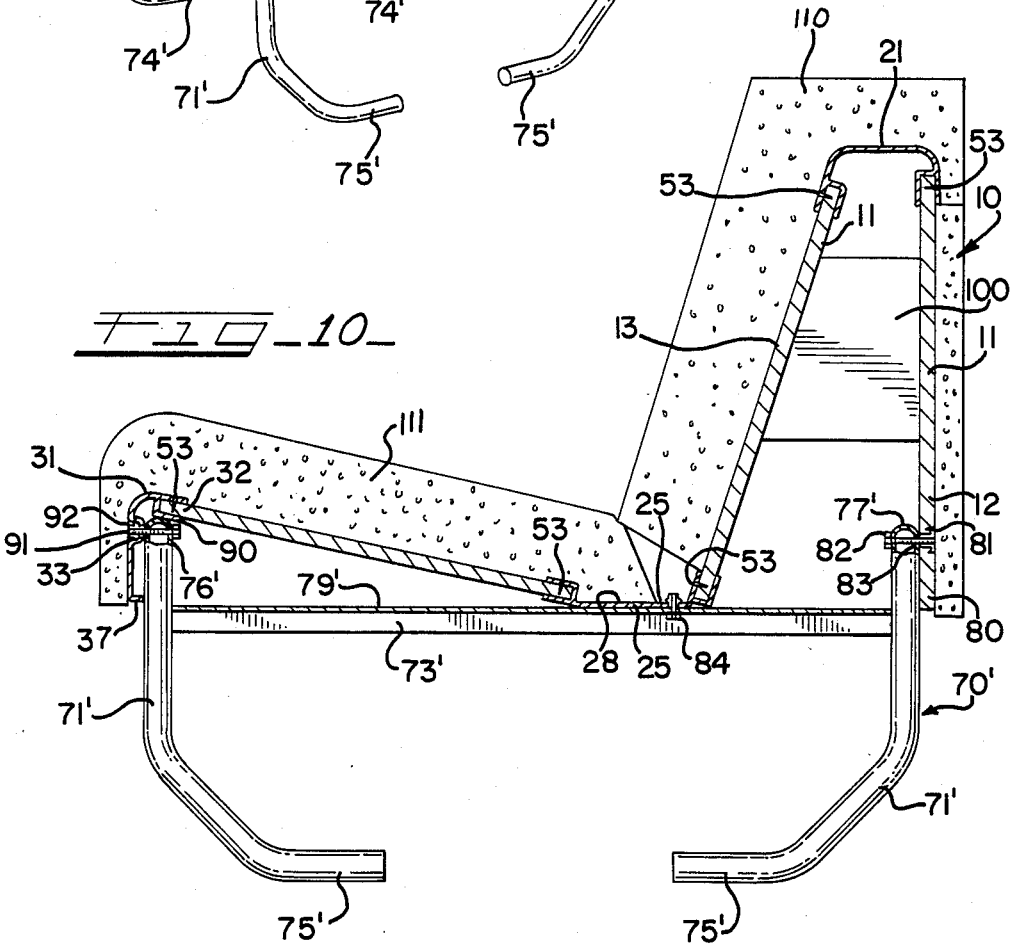
FIG. 10 is a side elevation view of the chair seat of this invention installed onto the preferred support frame of FIG. 9.

Forming or assembly fixture 56 has upwardly extending locating surfaces whereby the chair seat assembly of FIG. 6 can be either assembled on the fixture or preassembled and moved vertically down into the fixture to accurately locate each of the components with respect to each other. The components are then fixedly engaged to each other by adhesives or mechanical fasteners and the resulting assembly is removed from the fixture by vertical upward movement as a rigidly affixed chair seat structure. Attached to the structure, as shown in FIG. 10, is padding, such as foam rubber pads 110 and 111.

Figure 8:
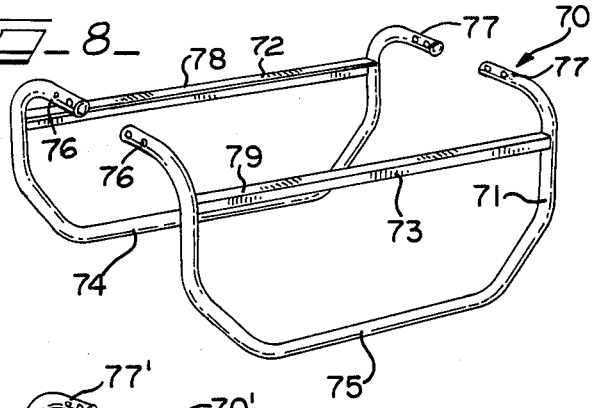
FIG. 8 is a perspective view of a prior art support frame for a chair seat.
Figure 9:
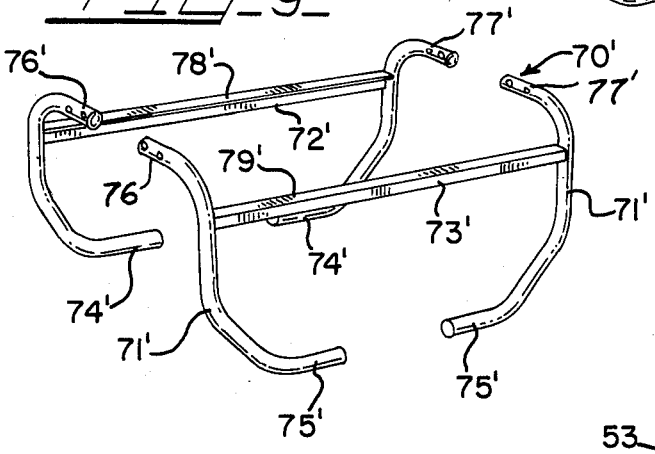
FIG. 9 is a perspective view of a preferred support frame to be used with this invention.

FIG. 8 shows in a perspective view a prior art chair base or frame 70 on which the one-piece chair seats shown in FIGS. 1 and 2 were generally installed and FIG. 9 shows a modified prior art chair frame 70′ on which the prior art chair seats were frequently installed. The frame 70′ of FIG. 9 is the frame on which the modular chair seats of this invention are preferably installed.

Chair frame 70 is made from a formed tubular member 71 and a first and second side brace 72 and 73 respectively. Lowermost portions 74 and 75 of member 71 serve to rest on a support surface, such as a floor. Upper connective members 76 and 77 provide supportive attachments for the chair seat and braces 72 and 73 provide upper surfaces 78 and 79, respectively, to supportively engage portion 6 of the prior art seats. These frames combined with the one-piece laminated chair seat tend to make the chair assembly susceptible to teetering when placed on an uneven surface.

Frame 70′ shown in FIG. 9 has the central or connective portions of lowermost portions 74′ and 75′ of member 71′ removed. This construction forms a strong frame capable of slight flexing or adjustment to conform to surface abnormalties present on a support surface on which the frame is placed.

FIG. 10 shows a side elevation view of a chair seat structure 10 of this invention installed on to a support frame 70′ to form a chair assembly.

As shown, the members 11 are maintained in the connective member receiving slots by a plurality of mechanical fasteners, such as staples 53.

As shown, planar member 11 in position 12, serving as the back member, has at its lower portion 80 a plurality of attachment means, such as nut 81 to which a fastener means, such as threaded member 82, is engaged through an opening 83 in portion 77′ of frame 70′.

Additionally, an attachment means, such as threaded nut and bolt assembly 84, is used to affix portion 28 of connective member 25 to a portion of the upper surface of each side brace as shown at 70' of side brace 73'.

At the front of the chair assembly, a lower portion 90 of slot 32 of connective member 31 rests upon and is supported by an upper surface of cross member 76' and a plurality of attachment means, such as nut and bolt assembly 91, in which the nut 92 is accommodated within channel 33, are used to rigidly engage connective member 31 to frame 70'.

Channel 33 and flange 37 serve as strength enhancing members and also as stand-offs to maintain connective member 31 properly located with respect to frame 70'.

The structure shown in FIG. 10 forms a strong, durable chair seat structure which is susceptible to neither warpage nor teetering. A support member 100 is provided between the members 11 at positions 12 and 13 to increase the central rigidity between these two members. Support member or board 100 is also shown in dashed lines in FIG. 3 to clarify its position.

The structure and method disclosed above can also be used to form a wedge-shaped chair seat such as those used at corners in modular furniture systems. In these applications, the three planar members and the three connective members would be of different sizes and widths, respectively, to accomodate the unique geometry required for these special application chair seats, but the basic construction would be the same with respect to the connections and constructions of the planar members and the connective members.

What is claimed is:

1. A chair seat comprising in combination:

three substantially rigid planar members, each of said planar members being of substantially the same size and interchangeable with each other, each of said planar members having two sides and two ends connecting said sides;

a plurality of connective members, each of said connective members having at least one planar member receiving means engaged with an end portion of one of said planar members for forming a chair seat assembly, each of said connective members being returningly deformable for enabling limited flexibility of said chair seat; and means for maintaining said planar members engaged with said connective members to which they are engaged, for maintaining said chair seat as a substantially rigid assembly.

2. The invention as defined in claim 1 in which said planar members are manufactured fiber board planar members.

3. The invention as defined in claim 1 in which said connective members are formed of a plastic.

4. The invention as defined in claim 1 in which said planar member receiving means is an elongated slot for receiving an end portion of a planar member.

5. The invention as defined in claim 4 in which said slot is comprised of a pair of substantially parallel walls having a closed end and an open end and said end portion of one of said planar members is received through said open end.

6. The invention as defined in claim 5 in which the pair of parallel walls are laterally spaced apart from each other a distance substantially equal to the thickness dimension of said planar member.

7. The invention as defined in claim 1 in which at least one of said connective members has two planar member receiving means for connecting two of said planar members together.

8. The invention as defined in claim 1 together with frame means for supportingly engaging said chair seat assembly.

9. A chair seat comprising:

a back connection board having a lower end and an upper end;

a back support board having an upper end and a lower end;

a seat support board having a rear end and a front end;

a first connection member having a first board receiving means for receiving an end portion of said upper end of said back connection board and a second board receiving means for receiving an end portion of said upper end of said back support board;

a second connection member having a first board receiving means for receiving an end portion of said lower end of said back support board, connection means for being connected to a chair base means and a second board receiving means for receiving an end portion of said rear end of said seat support board;

a third connection member having a board receiving means for receiving an end portion of said first end of said seat support board and a connection means for being connected to a chair base means; and each of said boards being substantially identical in shape and size to enable them to be interchangeable with respect to said first, second, and third connective members.

10. The invention as defined in claim 9 in which each of said boards is formed of a substantially rigid fiberboard and each of said connective members is formed of a plastic material.

11. The invention as defined in claim 9 in which said board receiving means in each of said connection members is an elongated slot.

12. The invention as defined in claim 11 together with mechanical fastener means for maintaining each of said end portions of said boards engaged with said slot.

13. The invention as defined in claim 12 in which said mechanical fastener means is a plurality of staples.

14. The invention as defined in claim 12 in which each of said slots is defined by as pair of substantially parallel walls having an open end and a closed end and the distance between said closed end and said open end is sufficient to enable a board up to $\frac{3}{8}$ inches out of square to be adjusted within said slot to be properly aligned with said connection member and to enable said board to be substantially rigidly engaged with said slot by placement of mechanical fastener through at least one wall of said slot and into said board.

15. A method of forming a chair seat assembly, said method comprising:

connecting a first two of three substantially equally dimensioned planar members together with a first connective member;

connecting a third of said three substantially planar members to one of said first two of said planar members with a second connective member;

placing a third connective member into connective engagement with said third planar member for forming said chair seat assembly.

16. The method as defined in claim 15 together with adjusting said planar members with respect to said connective members for causing said chair seat to define a preselected configuration.

17. The method as defined in claim 16 together with rigidly engaging said planar members to said connective members for maintaining said preselected configuration.

18. The method as defined in claim 16 in which said planar members are rigidly engaged with said connective members by mechanical fastening.

19. The method as defined in claim 18 in which said planar members are rigidly engaged with said connective members by adhering using an adhesive.

* * * * *

UNITED STATES PATENT AND TRADEMARK OFFICE

CERTIFICATE OF CORRECTION

PATENT NO. : 4,580,841

DATED : April 8, 1986

INVENTOR(S) : William B. Raftery

It is certified that error appears in the above-identified patent and that said Letters Patent are hereby corrected as shown below:

column 2, line 54--"3/4" should be "1/2"

column 3, line 42--"1/2" should be "3/4"

Signed and Sealed this

*Twenty-ninth* Day of *July 1986*

[SEAL]

*Attest:*

DONALD J. QUIGG

*Attesting Officer*

*Commissioner of Patents and Trademarks*